US005325952A

United States Patent [19]

McGinley et al.

[11] Patent Number: 5,325,952

[45] Date of Patent: Jul. 5, 1994

[54] ANTIRETRIEVAL DEVICE FOR CURRENCY VALIDATORS

[75] Inventors: John H. McGinley, Chardon; William D. Bruch, Solon; Vladimir Suris, Mayfield Hts.; John T. Lynch, Bedford Hts., all of Ohio

[73] Assignee: Dixie-Jarco, Inc., Eastlake, Ohio

[21] Appl. No.: 841,569

[22] Filed: Feb. 26, 1992

[51] Int. Cl.[5] ..... G07D 7/00

[52] U.S. Cl. ..... 194/203; 194/206

[58] Field of Search ..... 194/203, 206, 207; 271/181

[56] References Cited

U.S. PATENT DOCUMENTS 3,924,847 12/1975 Pescetto ..... 271/3
4,513,439 4/1985 Gorgone et al. ..... 194/206 X
4,858,744 8/1989 Dolejs et al. ..... 271/181 X
5,195,739 3/1993 Watabe ..... 194/203 X

*Primary Examiner*—F. J. Bartuska
*Attorney, Agent, or Firm*—Renner, Kenner, Greive, Bobak, Taylor & Weber

[57] ABSTRACT

An antiretrieval device for a currency validator of the slot acceptor type. A set of teeth is interposed between the cash box and the note path and in operative engagement with a punch plate. The punch plate and teeth define a shear to cut any string or tape which might be attached to a piece of currency tendered for validation. The teeth are maintained at the end of a spring-biased portion of a plate which is clamped and otherwise secured to a portion of the housing of the currency validator.

14 Claims, 2 Drawing Sheets

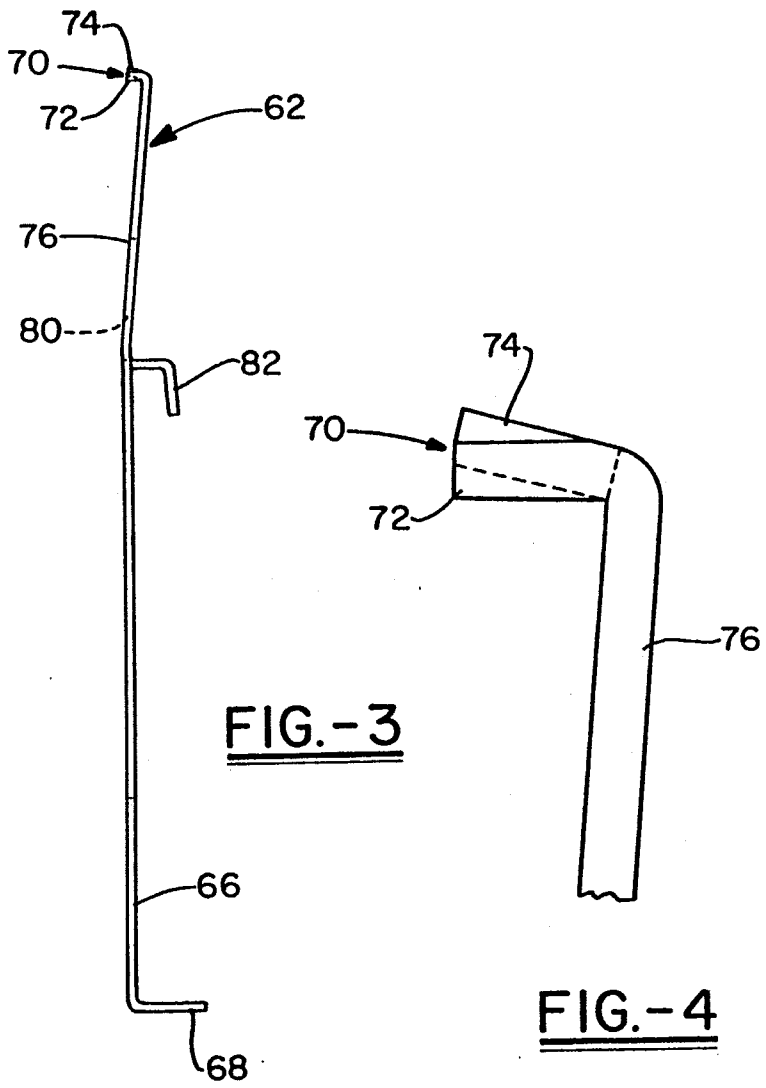
FIG.-3
FIG.-4
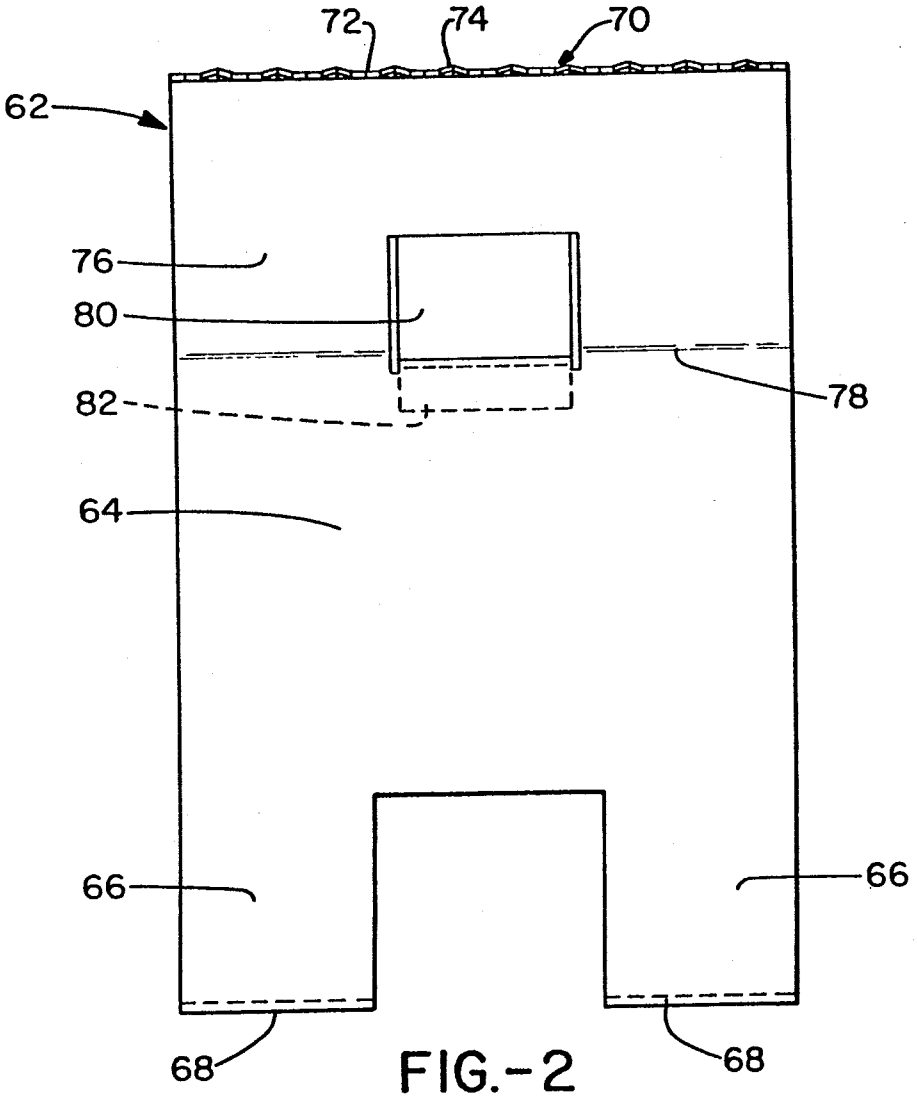
FIG.-2

ANTIRETRIEVAL DEVICE FOR CURRENCY VALIDATORS

TECHNICAL FIELD

The invention herein resides in the art of currency validators and, more particularly, to such validators of the slot acceptor type. Specifically, the invention relates to the inclusion of an apparatus in communication with a note path of the currency validator which prevents retrieval of validated currency.

BACKGROUND ART

Various types of currency validators and note acceptors are presently known in the art. Such currency validators receive a paper tendered as a piece of valid currency, perform various tests upon the paper to authenticate it, and then either accept the paper as valid currency, or reject and return it as an invalid tender. When accepted as valid currency, the paper is generally deposited into a cash box or other appropriate receptacle and the change and/or goods are dispensed in exchange. Attempts are often undertaken with such currency validators to retrieve the currency once it has been accepted as valid, and after the vend and/or change operation has been commenced or completed.

The invention herein relates to an antiretrieval device particularly adapted for implementation in currency validators of the slot acceptor type. In such devices, the paper tendered as a valid currency is introduced into a slot and transported by belts and/or rollers through a testing area and to an escrow position from which it is punched into a stack within a cash box. In such devices, the note path generally has a horizontal portion extending from the slot and in communication with a vertical portion from which it is punched into the cash box. It has been previously know that string or tape may be affixed to a piece of currency tendered to the currency validator and used as a device for subsequently retrieving the currency from the cash box after it has been accepted and the vend or change operation has been completed. It has previously been known that an invalid piece of paper may be purposely tendered to the currency validator following the acceptance of a valid piece of currency having string or tape attached thereto. The rejection of the invalid currency, accompanied by reverse rotation of the belts and rollers, aids the retrieval operation.

There is a need in the art for an anti-retrieval device to be used in association with the note path and between the note path and cash box which prevents such retrieval from the cash box once the currency has been accepted and deposited therein.

DISCLOSURE OF INVENTION

In light of the foregoing, it is a first aspect of the invention to provide an antiretrieval device within a currency validator of the slot acceptor type.

Another aspect of the invention is the provision of an antiretrieval device which may be added by retrofit to existing slot acceptor currency validators.

Still a further aspect of the invention is the provision of an antiretrieval device for use in a currency validator which is operative to cut or shear a string or tape appended to a piece of currency and to be used as a retrieval device.

Another aspect of the invention is the provision of an antiretrieval device for currency validators which shreds or tears the currency upon any attempted retrieval thereof.

Yet a further aspect of the invention is the provision for an antiretrieval device for currency validators which is reliable in use, and conducive to implementation with state of the art slot acceptors.

The foregoing and other aspects of the invention which will become apparent as the detailed description proceeds are achieved by a currency validator, comprising: a note path having a first portion substantially orthogonal to a second portion; a cash box adjacent said second portion of said note path; a punch plate opposite said cash box, said punch plate adapted for reciprocating movement across said second portion of said note path; and means interposed between said note path and said cash box for inhibiting retrieval of paper currency from said cash box and through said note path.

Yet other aspects of the invention are attained by the improvement in a currency validator having a note path comprising a horizontal portion interconnecting a vertical portion, a cash box opposite the vertical portion, and a punch plate in reciprocating communication with the cash box across the vertical portion, such improvement being an antiretrieval device, comprising: a set of teeth interposed at an end of the vertical portion of the path and between the cash box and the path.

DESCRIPTION OF DRAWINGS

For a complete understanding of the objects, techniques and structure of the invention reference should be made to the following detailed description and accompanying drawings wherein:

FIG. 2 is a top plan view of the antiretrieval device of the invention;

FIG. 3 is a side elevational view of the device of FIG. 2; and

FIG. 4 is a side elevational view of an end portion of the antiretrieval device of FIG. 2, showing the alternate angling of the teeth at the end thereof.

BEST MODE FOR CARRYING OUT THE INVENTION

Figure 1:
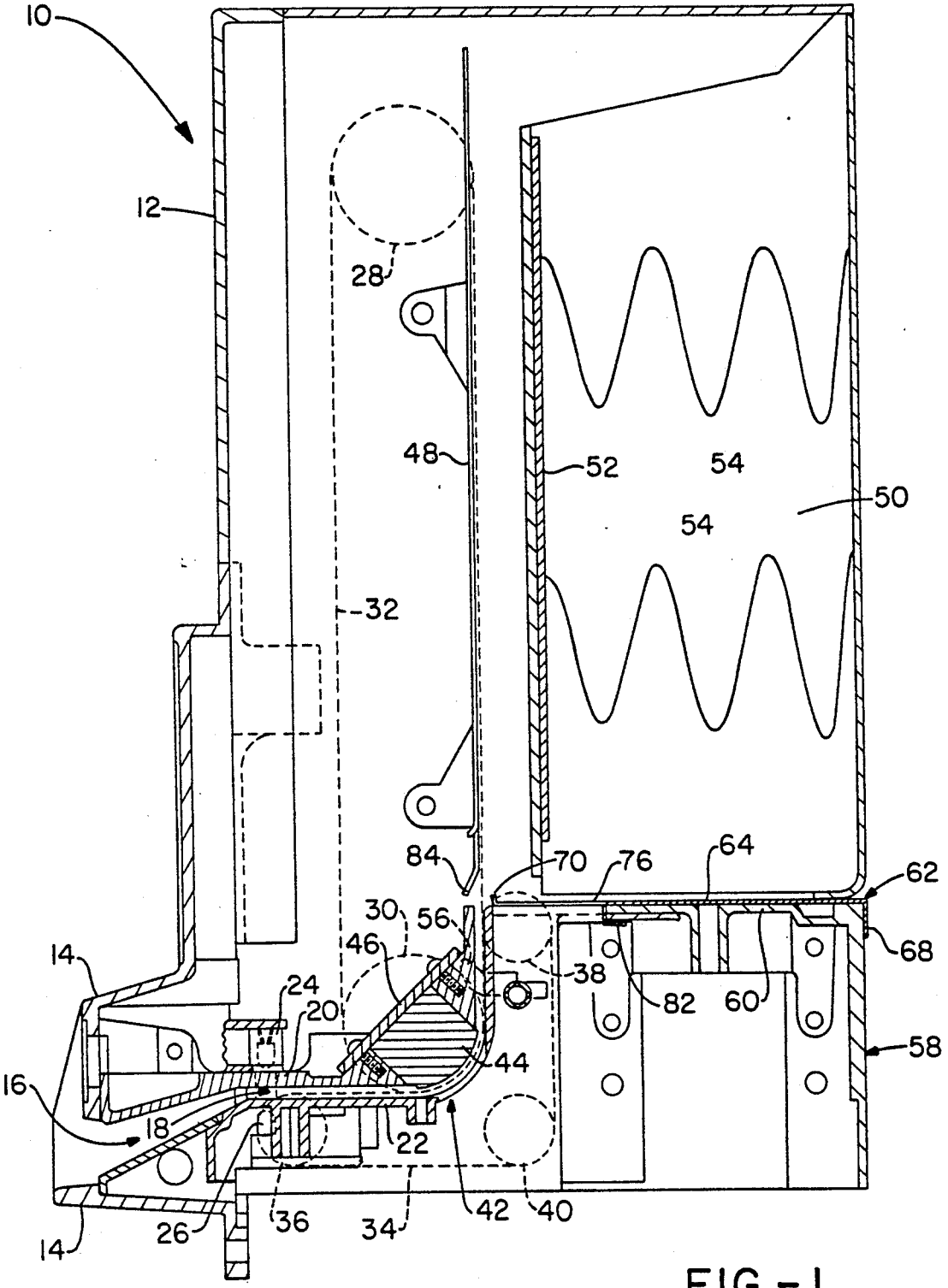
FIG. 1 is a cross sectional view of a currency validator of the slot acceptor type, showing implementation of the instant invention in communication with the note path thereof.

Referring now to the drawings and more particularly FIG. 1, it can be seen that currency validator and associated stacker is designated generally by the numeral 10. As shown, the currency validator 10 is maintained within an appropriate housing 12 having an escutcheon 14 at a front extension thereof, such escutcheon 14 having an appropriate slot 16 for receiving a piece of currency tendered for validation by the currency validator 10. Those skilled in the art will readily appreciate that the currency validator 10 is of the slot acceptor type, receiving the currency within the slot 16.

As further shown in FIG. 1, the slot 16 feeds into a note path 18 which is defined between a top sensor plate 20 and a bottom sensor plate 22. Maintained at the beginning of the note path 18, and at the end of the slot 16, is a light source 24 which is positioned opposite an appropriate light sensor 26. The light source 24 emits a light beam across the note path 18 which is sensed by the sensor 26. When the light beam is cut as by the presence of a piece of currency tendered therein, the currency validator 10 is advised that a tender has been made and the validation process commences.

Cutting of the light beam between the source 24 and the sensor 26 activates a motor connected to a drive roller 28. Those skilled in the art will appreciate that two drive rollers 28 exist, one on each side of the note path. Accordingly, the motor drives the rollers 28 to rotate a pair of belts 32 about a pair of rollers 30. Again, only the foremost belt 32 and idler roller 30 have been shown in the drawing. The belts 32 define the vertical portion of the note path 18, the currency validator 10 being an "upstacker," in which the bills are transported from a horizontal input section to an upwardly extending vertical section. Of course, the invention is also contemplated for implementation with note acceptors in which the note path may turn vertically downward, or in which the note path may have less than an orthogonal change of direction from a horizontal to a vertical portion.

Those skilled in the art will again appreciate that a driven belt 34 is engaged and driven by the belt 32 to define a lower portion of the note path 18. The driven belt 34 moves in an L-shaped path about idler pulleys 36, 38, 40 as shown. Accordingly, the belt 34, in engagement with and driven by the belt 32, defines a first horizontal portion of the note path 18, as well as a transition portion interconnecting the horizontal and vertical legs thereof.

The transition of the note path defined above is designated generally by the numeral 42. This bend in the note path defines a bite between the belts 32, 34 such that a single drive motor is necessary to achieve transporting movement of both belts. Further, this bite assures that a note or bill tendered into the note path 18 is engaged along both lateral edges thereof and transported by the pairs of interengaging belts 32, 34 along each side of the note path 18. Again, only one such side of the note path is shown herein for purposes of illustration, the structure presented thus far being well known to those skilled in the art.

A magnetic sensor 44 is maintained at the bend 42 in the note path 18 to be in engagement with the currency at the bend as it undertakes the transition from the horizontal to the vertical portions of the note path. The magnetic sensing head 44 is maintained by a mounting assembly 46 to assure close contacting engagement with the currency to achieve proper readings.

As the bill is being transferred past the magnetic reading head 44, a determination is made as to whether the bill satisfies the testing criteria. If not, the motor driving the drive rollers 28 is reversed and the bill is returned from the note path 18 and out of the slot 16. If, however, the paper tendered as valid currency satisfies the test of the sensing head 44, it continues along its path, driven by the belts 32 upon side rails (not shown), and beyond the rear clear tines or levers 56. As is well known to those skilled in the art, the rear clear levers 56, tripped by the passing bill and allowed to return after the bill has completely cleared the times, indicates that the bill is out of the testing area and totally within the vertical portion of the note path. The transporting system of the belts 32, 34 is terminated by cessation of the motor driving the rollers 28. A reciprocating punch plate 48, maintained opposite a cash box 50, is then actuated. The punch plate 48 traverses the note path 18 and impinges the paper currency upon a platen 52 which is maintained within the cash box 50 and spring biased by appropriate springs 54. The punch 48 deflects the currency passed side rails (not shown), and into the cash box against the spring biased platen 52. As the punch plate 48 returns to its initial position, the spring 54 urge the bill, and those in the stack received before it, against front side rails (not shown) of the cash box 50 to retain the stack of bills therein.

Also included as part and parcel of the currency validator and stacker 10 is a transformer housing 58 which, as an integral portion thereof, includes the bottom sensor plate 22. Those skilled in the art will appreciate that the transformer housing 58 is pivotally interconnected to the housing 12 such that the L-shaped portion of the note path 18 may be opened by limited separation of the housing 58 from the housing 12.

A top casting 60 is provided as part and parcel of the housing 58 and receives thereon an antiretrieval device 62, shown in more detail in FIGS. 2–4. As shown, the antiretrieval device 62 is configured in the form of a plate 64 having a pair of legs 66 extending from one end thereof. Each of the legs 66 has a flange 68 also extending therefrom, the flanges 68 being substantially perpendicular to the plate 64 and extending legs 66. As further shown in FIGS. 2–4, the other end of the plate 64 is characterized by the presence of a plurality of teeth 70 extending upwardly therefrom. The teeth are sharpened, as best shown in the plan view of FIG. 2, such sharpness further being enhanced by the somewhat thin nature of the metal of the plate 64, having a thickness on the order 0.010–0.030 inch. As best shown in FIG. 4, a set of teeth 70 which extend across the entire one end of the plate 64, comprise alternating teeth 72, 74 which are angled with respect to each other. In the preferred embodiment of the invention, the teeth 72, 74 have an angular difference between them on the order of 10–15 degrees when taken with respect to an end portion 76 of the plate 64. In the preferred embodiment of the invention, the teeth 72 extend perpendicularly from the plate 76, while the alternate teeth 74 extend at an angle of approximately 78 degrees, providing for a 12 degree angular difference between the teeth 72–74.

In the preferred embodiment of the invention, the end portion 76 of the plate 64 is bent so as to be spring biased with respect to the remainder of the plate. The plate 64 is bent along the line 78 as shown in FIGS. 2 and 3 to provide a spring-biased feature in association with the end portion 76.

Also associated with the end portion 76 is a U-shaped clamp 82 which extends beneath the plate 64 on the same side thereof as the flanges 68. The U-shaped clamp 82 is formed from the material removed from the end portion 76 to provide the opening or window 80 therein. Those skilled in the art will appreciate that a standard staking operation can achieve the desired removal of the material necessary to define the opening 80 and to develop the clamp 82.

With reference again to FIG. 1, it can be seen that the antiretrieval device 62 is received upon the top casting 60 of the housing 58 such that the flanges 68 extend over a back edge of the housing 58, while the clamp 82 passes through an opening in the top casting 60 and is secured over the thickness thereof. The spring-biased end portion 76 urges the clamp 82 into gripping engagement with the thickness of the casting 60, while further assuring engagement of the flanges 68 at the rear of the housing 58. This positioning of the antiretrieval device 62 assures that the set of teeth 70 are maintained between the note path 18 and the cash box 50 and at a bottom end of the vertical portion of the note path 18 and a bottom end of the cash box 50. Further, the bottom edge 84 of the reciprocating punch plate 48 is provided so as to either slightly interfere with, or barely clear the set of teeth 70. In a preferred embodiment of the invention, the clearance between the bottom edge 84 of the punch plate 48 and the top edges of the set of teeth 70 is from 0 to 0.010 inch. Accordingly, as the plate 48 reciprocates, a shearing action is achieved between the bottom edge 84 and the teeth 70.

It will be appreciated by those skilled in the art that the shearing action between the edge 84 of the punch 48 and teeth 70 assures that any tape or string attached to a piece of currency will be cut as the punch plate 48 moves the currency into the cash box 50. Even if not sheared, any attempt to retrieve the bill from the cash box 50 will be greatly impeded by the presence of the alternating sets of sharp teeth 72, 74 which will tend to tear or shred the bill being so retrieved. The positioning of the teeth between the cash box and note path at the bottom of the note path and in juxtaposition to the bend therein assures such shearing, tearing, and abrading action should retrieval be attempted.

Thus it can be seen that the objects of the invention has been satisfied by the structure presented above. While in accordance with the patent statutes only the best mode and preferred embodiment of the invention has been presented and described in detail, it will be appreciated that the invention is not limited thereto or thereby. Accordingly, for an appreciation of the true scope and breadth of the invention reference should be made to the following claims.

What is claimed is:

1. A currency validator, comprising:

a note path having a first portion substantially orthogonal to a second portion;

a cash box adjacent said second portion of said note path;

a punch plate opposite said cash box, said punch plate adapted for reciprocating movement across said second portion of said note path; and means interposed between said note path and said cash box for inhibiting retrieval of paper currency from said cash box and through said note path, said means comprising an array of teeth maintained at a first end of a plate, said plate being secured to a housing defining a portion of said note path, said plate having a pair of flanges extending from a second end thereof opposite said first end, said flanges securing said plate over an edge of said housing.

2. The currency validator according to claim 1, wherein said means is operative to engage, rip, abrade, and tear the paper currency.

3. The currency validator according to claim 2, wherein said means is in juxtaposition to an edge of said punch plate.

4. The currency validator according to claim 3, wherein said means and said edge interact as a shear during said reciprocating movement of said punch plate.

5. The currency validator according to claim 4, wherein said teeth are sequentially alternately angled into said interaction with said edge.

6. The currency validator according to claim 1, wherein said plate has a clamp extending therefrom and engaging said housing.

7. The currency validator according to claim 6, wherein said first end of said plate is spring biased, urging said clamp into engagement with said housing.

8. In a currency validator having a note path comprising a horizontal portion interconnecting a vertical portion, a cash box opposite the vertical portion, and a punch plate in reciprocating communication with the cash box across the vertical portion, the improvement of an antiretrieval device, comprising:

a set of teeth interposed at an end of the vertical portion of the note path and between the cash box and the note path, said set of teeth traversing an end of a plate secured to a casing of the currency validator, said end of said plate being spring biased.

9. The improvement of an antiretrieval device in a currency validator according to claim 8, wherein said set of teeth are maintained in juxtaposition to an edge of the punch plate.

10. The improvement of an antiretrieval device in a currency validator according to claim 9, wherein said set of teeth and said edge of said punch plate are in shearing operative engagement.

11. The improvement of an antiretrieval device in a currency validator according to claim 10, wherein said set of teeth traverses a width of the note path and cash box.

12. The improvement of an antiretrieval device in a currency validator according to claim 10, wherein each of said teeth is oppositely angled with respect to adjacent teeth.

13. The improvement of an antiretrieval device in a currency validator according to claim 8, wherein said plate has a flange engaged with the casing.

14. The improvement of an antiretrieval device in a currency validator according to claim 13, wherein said plate has a clamp adjacent said spring-biased end portion and engaging the casing.

* * * * *